United States Patent [19]

Hantelmann

[11] 4,413,669

[45] Nov. 8, 1983

[54] METHOD OF HEAT EXTRACTION FROM AN AQUEOUS CARRIER MEDIUM

[75] Inventor: Harald Hantelmann, Ravensburg, Fed. Rep. of Germany

[73] Assignee: Escher Wyss Limited, Zurich, Switzerland

[21] Appl. No.: 258,929

[22] Filed: Apr. 30, 1981

[30] Foreign Application Priority Data

May 20, 1980 [CH] Switzerland ..... 3918/80
May 30, 1980 [DE] Fed. Rep. of Germany ..... 3020504

[51] Int. Cl.[3] ..... F28C 3/08

[52] U.S. Cl. ..... 165/1; 62/79; 62/238.6; 165/DIG. 12; 122/412

[58] Field of Search ..... 237/2 B, 11; 165/1, 165/DIG. 2, DIG. 12, 45; 122/412; 62/85, 86, 87, 88, 238.6, 79

[56] References Cited

U.S. PATENT DOCUMENTS 3,986,664 10/1976 Gustafsson ..... 237/2 B
4,050,445 9/1977 Huse ..... 126/422
4,149,585 4/1979 Sterlini ..... 165/1
4,323,109 4/1982 Jaster ..... 237/2 B

OTHER PUBLICATIONS

Neil, DT, *Geothermal Powered Heat Pumps to Produce Heat,* 1976, pp. 802–804.

*Primary Examiner*—Albert J. Makay
*Assistant Examiner*—Henry Bennett
*Attorney, Agent, or Firm*—Robert A. Ostmann

[57] ABSTRACT

In a method of heat extraction from an aqueous carrier medium through its expansion, the expansion is undertaken step by step in a number of expansion stages arranged consecutively as regards the flow of the medium. The vapor produced in each expansion stage is removed from the stage, and the individual vapors are subjected, respectively, parallel to each other, to a thermal utilization or revalorization.

According to one embodiment, the carrier medium is boiler feed water, which is circulated via a heat absorption zone and through the expansion stages. The vapor produced undergoes thermo-compression and is fed to a common steam bar. The heat absorption zone, heat exchangers are heated by a source of waste energy. A produce of this method is a pure water vapor.

4 Claims, 1 Drawing Figure

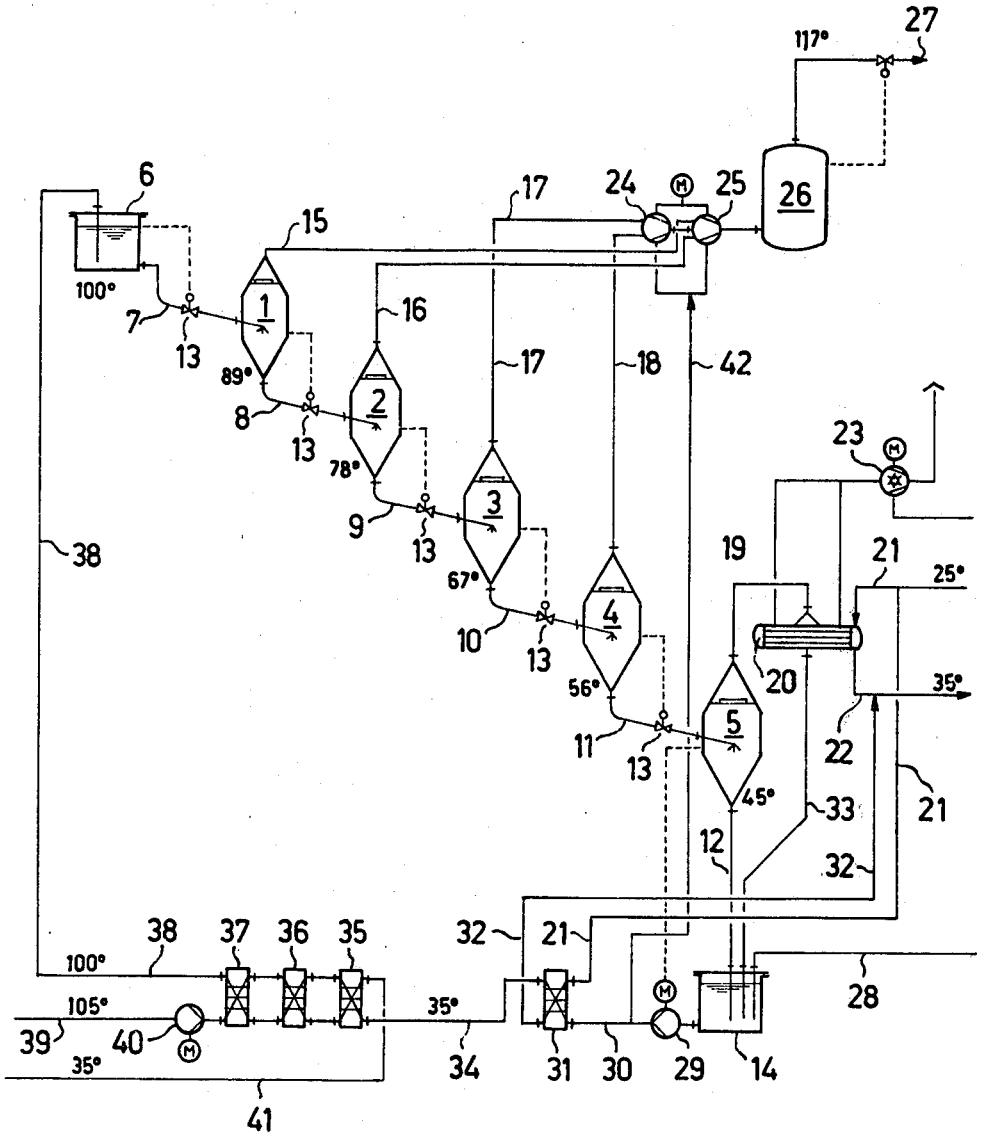
27
117°
26
24
25
17
6
15
100°
7
13
1
89°
16
2
8
78°
9
3
67°
10
4
56°
11
5
45°
12
18
42
23
19
21
25°
20
35°
22
33
32
38
37
36
35
100°
105°
39
40
35°
41
34
31
30
29
14
28

METHOD OF HEAT EXTRACTION FROM AN AQUEOUS CARRIER MEDIUM

BACKGROUND OF THE INVENTION

The invention relates to a method of heat extraction from an aqueous carrier medium through its expansion on thermal utilization or revalorization of the resulting vapour.

On grounds of efficient utilization of energy and protection of the environment, one is being increasingly led to avoid any, even relatively small, thermal loss or burden on the environment. The known technical solutions to this, eg. heat extraction from a carrier medium at the end of a process, the so-called heat recovery, present themselves here. Provisions such as these, however, involve equipment or running costs and so attempts are made to achieve an economic co-product with such processes to clear, at least in part, the costs incurred.

It is known to be economical to use the heat of the resulting vapours on expansion of a medium, to then heat a receiver, a thermoconsuming device with the vapour directly or via an intercalated thermo-compression.

However, on expansion of carrier mediums of lower temperatures, in particular below their boiling point, the increasing volumes of vapour cause calibration difficulties in the apparatus which greatly detract from the profitability of such processes.

SUMMARY OF THE INVENTION

The aim of the invention is to find a solution to design, in an economic way, methods of the kind described in the introduction, in particular where the temperature of a carrier medium lies below its boiling point. A further aim is to extract heat from a contaminated carrier medium and to convert it into another directly usable form of energy eg. in the form of a pure water vapour, which could be of a higher temperature than that of the contaminated carrier medium.

To solve these problems, it is suggested, according to the invention, that expansion is undertaken step by step, in a number of successive expansion stages as regards the flow of the medium, and that the steam produced in each stage of expansion is removed from the stage and the individual vapours undergo a thermal utilization or revalorization parallel to each other.

The carrier medium being boiler feed water, which is circulated over a heat absorption zone and through the expansion stages, whereby the vapour produced in the individual expansion stages undergoes thermal compression, and the heat absorption being from a contaminated warm medium, the method produces a pure water vapour.

BRIEF DESCRIPTION OF THE DRAWING

To explain the method and the advantages to be achieved through it, an advantageous example embodiment is described and explained in more detail, by means of a scheme shown in the drawing of an installation designed for that purpose.

DESCRIPTION OF THE PREFERRED EMBODIMENT

The installation shown in the drawing, for heat extraction from an aqueous carrier medium, has a number of expansion stages, namely five stages 1,2,3,4 and 5. The expansion stages are arranged in series as regards the flow of the medium. The carrier medium flows as a cascade from the container 6, via a pipe 7, into the first expansion stage 1, via pipe 8 into expansion stage 2, via pipe 9 into expansion stage 3, via pipe 10 into expansion stage 4 and via pipe 11 into the final expanison stage 5 regulated each time at intermediate regulating valves 13. The expanded medium flows out from the final expansion stage 5 via pipe 12 into a reservoir 14.

The heat is extracted from the carrier medium such that the resulting vapour produced in each expansion stage is removed, and namely in such a way that the individual vapours produced in the individual expansion stages 1,2,3,4 and 5 are conveyed into pipes 15,16,17,18 and 19 arranged parallel to each other, from the respective expansion stages, for thermal utilization or revalorization to which they are subjected.

Thermal utilization of the extracted heat from the final expansion stage 5 takes place in a condenser, whereby cooling water 21 is heated up to hot water 22. A vacuum pump 23 opening out into the atmosphere provides a necessary vacuum in the pipe area of the condenser 20.

The vapours produced in the upper expansion stages 1,2,3 and 4 undergo thermal utilization by thermo-compression: The vapours are drawn in and compressed in thermo-compressors 24 and 25 arranged parallel to each other. The vapour, having a higher temperature after each respective thermo-compression is fed to a common vapour bar which is given here with a vapour container 26. The vapour is passed out of the vapour container 26 by a pipe 27 into a vapour consumption network.

The thermo-compressors used here each have correspondingly designed operating spaces to receive the various volumes of the vapours coming from the individual expansion stages. They are also designed such that the compressed vapours are approximately equal in temperature. It is also possible that these two thermo-compressors here can be joined to a tandem engine, which would of course be even more economical from an energy point of view. But in this connection other combinations are also conceivable. Each line of vapour 15,16,17 and 18 could be subjected to thermal utilization or revalorization independently of the others. The output temperatures of the thermo-compressed vapours could be different. Some lines could be thermo-compressed, others fed only if necessary via a vacuum pump to any thermo-consuming device, and other possibilities besides.

The heating steam available according to this example embodiment is a pure water vapour. The carrier medium present here is namely pre-cleanded boiler feed water, which is fed via a pipe 28 into the reservoir 14. The boiler feed water is circulated in the system via a heat absorption zone and through the expansion stages. The expanded carrier medium, the boiler feed water after heat extraction, arrives back into the reservoir 14, into which the condensate is also fed from the heat exchanger 20 via pipe 33. It is expedient to cool down the carrier medium before heat absorption: The medium is conveyed by a pump 29 and a pipe 30 through a cooler 31. Heat extraction occurs here in indirect heat exchange with cooling water, which is conveyed from the common cooling water pipe 21 via pipe 21' to the cooler 31. The heated water flows from the cooler 31 back via pipe 32 into the hot water collecting pipe 22. After this expedient cooling, the carrier medium is conveyed via pipe 34 to the heat absorption in heat exchangers 35,36 and 37 connected in series. After heat absorption the carrier medium is conveyed into the container 6 via a pipe 38.

The heat absorption zone is the set of indirect heat exchangers 35,36 and 37, which is heated from a source of waste heat: a hot suspension, contaminated with inorganic waste salts is conveyed by a pipe 39 and a pump 40 through the heat exchangers 37,36 and 35 and cooled down, after transmission of heat to the carrier medium, drawn off via a pipe 41 into an overflow system.

The method described as an example has the following advantages in the field of efficient utilization of energy and protection of the environment, and also as regards profitability:

Heat is utilized which would previously have been wasted and would have been a burden on the environment.

It is possible to produce "pure" energy from "polluted" waste heat.

The kind of revalorization, on application of additional electrical energy for thermo-compression, is extremely economical.

This is demonstrated by means of some parameters of a concrete example embodiment:

The waste heat presents itself with a spent liquor present in a volume of 300 $m^3/h$, which on heat absorption on the part of the carrier medium is cooled down from 103° to 35°, and can be transferred in this state to the overflow system.

Through the heat absorption, the boiler water is heated up from 25° to 100°. It is expanded in the expansion stages 1 to 4, and the vapours are converted through thermo-compression to 26 t/h heating steam from 1.8 bar and 117°. A portion of the boiler feed water, approximately 2 $m^3/h$, is included here, which is injected and vaporized via a pipe 42 directly into the compressors 24 and 25.

In the cooling system of the installation, 773 $m^3/h$ water is heated up from 25° to 35° in the condensor 20 and cooler 31. If a comparison is made between the total consumption for the electrical energy used in thermo-compression and elsewhere, eg. in pumps of 2600 kW/h at a cost of 0.08 DM/kWh and the consumption for the production of vapour using natural gas, per 20 DM/t vapour there is a saving of 312 DM/h per running hour.

The method therefore brings with it, amongst other aspects, a great economic effect.

I claim:

1. A method of cooling and thereby utilizing the inherent heat of a hot industrial refuse comprising a salts laden or otherwise contaminated aqueous medium which is at a temperature below its normal boiling point and which, as a result, becomes better disposable as far as the environment is concerned, the method comprising the steps of passing the hot contaminated refuse in indirect heat transfer relation with clean boiler feed water which is at a lower temperature in a heat absorption zone to thereby heat the feed water and cool the contaminated refuse without comingling the two media; chilling the heated feed water by passing it through an expansion zone separate from the heat absorption zone and comprising a plurality of serially arranged expansion stages, whereby pure water vapor is produced from the feed water in each stage and a chilled feed water portion occurs at the last stage; passing said chilled feed water portion back to the heat absorption zone to thereby utilize that portion to cool additional hot refuse; and effecting expansion in said stages by separately withdrawing the vapors of the individual stages and subjecting the main portion of those vapors in parallel to thermo compression to produce therefrom pure consumable steam at a temperature higher than the temperature of the hot contaminated refuse which is being cooled.

2. A method as defined in claim 1 including the step of feeding the compressed vapors of the individual expansion stages to a common steam bar, whereby the steam leaving the bar has a temperature higher than the temperature of the medium the inherent heat of which is to be utilized.

3. A method as defined in claim 1 in which the vapors to be compressed are fed separately to various stages of a multi-stage thermo compressor, the individual stages of the compressor being dimensioned for sucking up and compressing the volumes of vapors supplied to them.

4. A method as defined in any one of claims 1, 2 and 3 in which said indirect heat transfer is effected in a plurality of heat exchangers connected in series.

* * * * *